United States Patent [19]

Guaglione

[11] 3,983,346

[45] Sept. 28, 1976

[54] TWO-PRESSURE GAS CIRCUIT BREAKER WITH LOW PRESSURE GAS HEATING

[75] Inventor: Giovanni Paolo Guaglione, Irvine, Calif.

[73] Assignee: I-T-E Imperial Corporation, Spring House, Pa.

[22] Filed: Nov. 22, 1974

[21] Appl. No.: 526,416

[52] U.S. Cl. ..... 200/148 R; 200/148 BV; 174/31 R

[51] Int. Cl.[2] ..... H01H 33/82

[58] Field of Search ..... 174/31 R; 200/148 R, 200/148 B, 148 D, 148 E, 148 BV

[56] References Cited

UNITED STATES PATENTS

| | | | |
|---|---|---|---|
| 3,045,086 | 7/1962 | Leeds et al. | 200/148 B |
| 3,566,001 | 2/1971 | McCloud | 174/31 R |
| 3,885,114 | 5/1975 | Guaglione et al. | 200/148 R |
| 3,889,083 | 6/1975 | Guaglione et al. | 200/148 R |
| 3,889,084 | 6/1975 | Kucharski | 200/148 B |
| 3,903,388 | 9/1975 | McConnell | 200/148 B |

*Primary Examiner*—Gerald P. Tolin
*Attorney, Agent, or Firm*—Ostrolenk, Faber, Gerb & Soffen

[57] ABSTRACT

The gas-filled bushing of a two-pressure circuit breaker has a hollow central conductive stud. Heated gas is injected into the annular chamber between the stud and the porcelain jacket of the insulator at the insulator flange, and the chamber is isolated from the interior of the circuit breaker housing. This gas flows up to the top of the bushing and into the open center of the conductive stud, and down into the low-pressure housing of the circuit breaker. A gas orifice restricts the flow of gas into the bushing to a small value and a compressor maintains a given pressure differential between the low-pressure gas and its high-pressure source. The heated gas maintains the gas in the bushing and in the housing at a temperature greater than −40°F.

6 Claims, 3 Drawing Figures

TWO-PRESSURE GAS CIRCUIT BREAKER WITH LOW PRESSURE GAS HEATING

RELATED APPLICATIONS

This application is related to copending U.S. application Ser. No. 524,471, filed Nov. 18, 1974, in the name of G. P. Guaglione et al, entitled GAS-FILLED HIGH CURRENT BUSHING WITH FORCED COOLING ARRANGEMENT, and assigned to the assignee of the present invention.

BACKGROUND OF THE INVENTION

This invention relates to gas-filled bushings for twopressure circuit breakers, and more specifically relates to a novel arrangement for preventing liquefaction of the dielectric gas in a gas-filled bushing and in the low-pressure region of the circuit breaker at low temperatures and for ensuring the dryness of the gas in a gas-filled bushing when used in a two-pressure system.

Gas-filled high voltage bushings are well known in the electrical power art. A typical high-voltage gas-filled bushing is shown in U.S. Pat. No. 3,566,001 in the name of McCloud, issued Feb. 23, 1971 and entitled GAS FILLED BUSHING WITH SPRING BIAS CLAMPING AND INTERNAL FLEXIBLE SHUNT. Bushings of this type are used for high voltage two-pressure gas blast circuit breakers of the type shown in copending application Ser. No. 398,871, filed Sept. 19, 1973 now U.S. Pat. No. 3.909,571, in the name of Aumayer, entitled CONTACT STRUCTURE FOR HIGH VOLTAGE GAS BLAST CIRCUIT INTERRUPTER, and assigned to the assignee of the present invention. A high dielectric gas such as sulfur hexafluoride or other gases mixed with sulfur hexafluoride fills the bushing and communicates with the interior of the low-pressure main housing of the circuit breaker which receives the bushing. The gas is stationary within the bushing and circuit breaker housing and is at a low pressure of, for example, three atmospheres. The gas is supplied from a high-pressure container which will be at a pressure of greater than about fifteen atmospheres. The bottom of the conductive studs of the bushings are then electrically connected to the contacts of interrupter structures which contain blast valves to allow high pressure gas to blast through the contacts and into the low pressure housing when the contacts are operated.

The low-pressure gas system of two-pressure $SF_6$ circuit breakers as pointed out above is at a pressure of about 45 p.s.i.g. at 70°F. The saturation characteristic of $SF_6$ is such that gas at 45 p.s.i.g. begins to liquify at temperatures slightly below −40°F. Temperatures of −40°F can be experienced, particularly in the more northerly regions of the North American Continent. The partial liquefaction of the gas will cause a reduction in the pressure in the lowpressure system, thereby reducing the dielectric insulation between the various circuit breaker parts and bushing parts. Moreover, the liquefaction in the bushing can give rise to possible contamination, which may cause dielectric tracking.

In the past and to overcome the problem of liquefaction of the low-pressure gas in the low-pressure portion of a two-pressure breaker, the normal engineering choice would be to lower the pressure in the two-pressure system to about 30 p.s.i.g. at 70°F as contrasted to the nominal 45 p.s.i.g. at 70°F. which is now used. The lowering of the gas pressure, however, would require larger clearances between parts and, therefore, is not economical.

BRIEF SUMMARY OF THE PRESENT INVENTION

In accordance with the present invention, a novel bushing structure is provided wherein heated dielectric gas is injected into the bushing and into the annular volume between the bushing porcelain and its central conductive member. Moreover, this annular volume is isolated from the interior of the circuit breaker housing. This injected heated gas then moves up the porcelain housing to the top of the hollow central bushing conductor, and then into and down the hollow conductor, and into the interior of the circuit breaker housing. A permanent connection exists between the high-pressure supply of the circuit breaker and the interior of the bushing, and a permanently open but narrow restriction permits a given flow of gas from the high-pressure supply into the bushing, through the stud, into the circuit breaker interior, and then to the compressor which causes the continuous circulation of gas through the low-pressure system in the above manner.

The source of this heated gas is the gas from the heated high-pressure gas reservoir which supplies gas to the high-pressure portion of the system and conventionally is at about 265 p.s.i.g. at 70°F. Liquefaction in the high-pressure system occurs at about 54°F., but liquefaction in this portion of the system is prevented through the use of heater blankets which surround the high-pressure gas cylinders and maintain the high-pressure gas at about 70°F.

The present invention takes advantage of the presence of this heated high-pressure gas and continually channels this high-pressure gas through gas restrictions which bring the high-pressure gas into the bushing interior and from the bushing into the interior of the grounded tank which carries the circuit breaker components. More specifically and in accordance with the invention, the heated high-pressure gas is channelled through pipes created either internally or externally of the breaker which are equipped with a gas orifice to regulate the flow of gas and optionally may contain a gas filter to maintain dryness in the bushing. The gas flows through the bushing center clamp flange and into the interior of the bushing.

One typical restriction that has been used permits a gas flow of about 0.4 cubic feet per minute into the lowpressure gas bushing, with a pressure drop of about 220 p.s.i.g. across the restriction. This injects about 1.6 BTU's per minute of heat energy which will maintain the low-pressure gas temperature above −40°F. in ambients of about −50°F. Thus, the novel invention permits the use of two-pressure circuit breakers in very low temperature environments, for example, those having ambient temperatures below −40°F., without requiring additional heat exchanging equipment to heat the gas in the low-pressure portion of the system. Moreover, by moving the gas through line gas filters, moisture in the gas is continually removed to prevent possible condensation of moisture in the internal porcelain structure of the bushing.

DETAILED DESCRIPTION OF THE DRAWINGS

Figure 1:
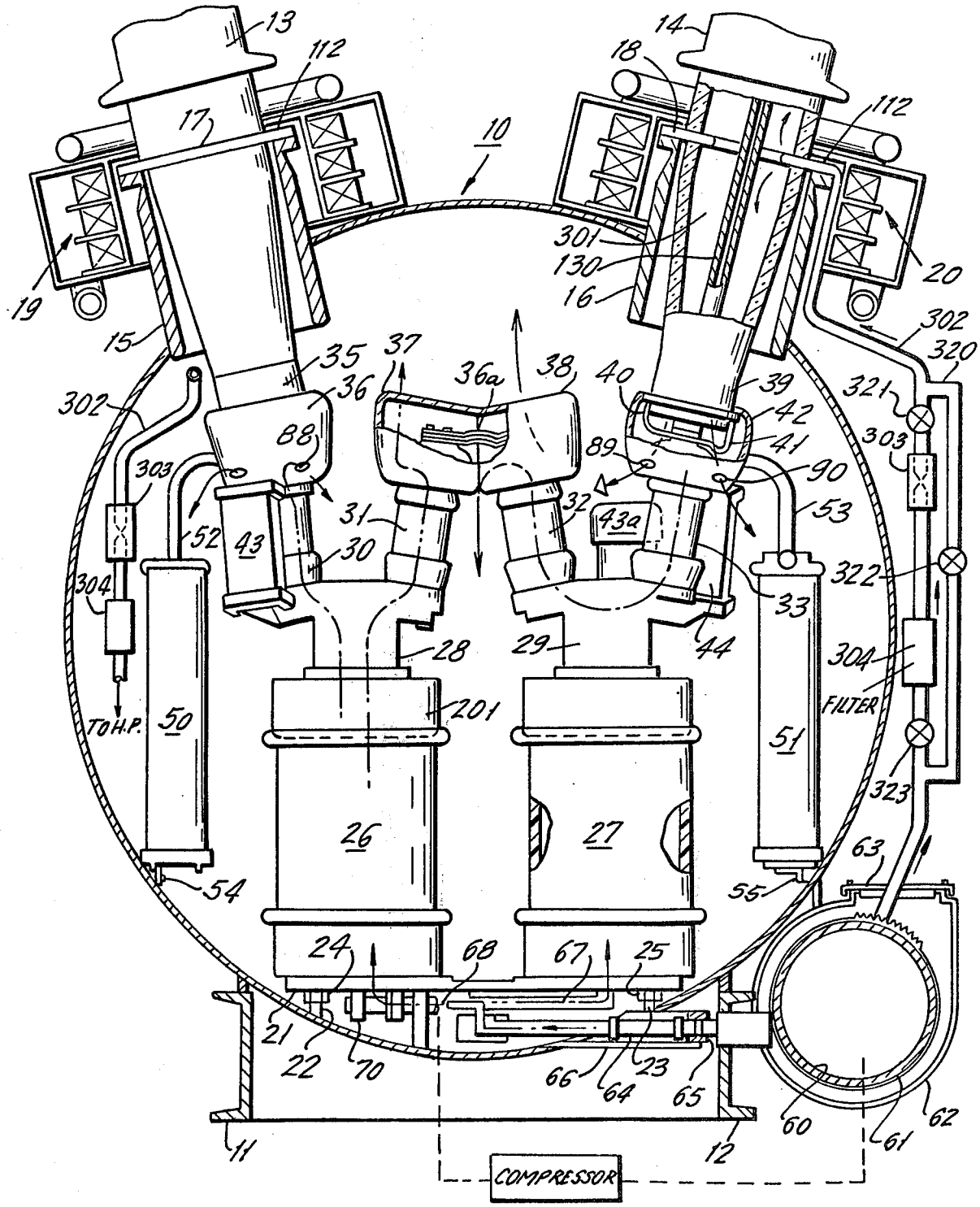
FIG. 1 is a cross-sectional view which diagrammatically illustrates the novel system in connection with a high-voltage two-pressure circuit breaker.

Referring now to the drawings, the circuit breaker shown in FIG. 1 is essentially identical to the circuit breaker of copending application Ser. No. 398,871, now U.S. Pat. No. 3,909,571, where, however, the bushing structure has been modified in accordance with the invention and is coupled to the high-pressure tank supply as will be later described.

Referring first to FIG. 1, there is shown, in partial section, one phase of a high voltage circuit breaker which incorporates the present invention, as will be later described. The circuit breaker of FIG. 1 can, for example, be rated at 230,000 volts and at 40, 50, 63, 80 and 100 kilo amperes interrupting current and 2000, 3000, 4000, 5000 and 6000 amperes continuous current respectively. Conventionally, the breaker will be a three-phase breaker and two other and identical phases to the one shown in FIG. 1 will also be provided.

In general, the circuit breaker phase of FIG. 1 is contained within a generally flattened spherical metallic tank 10 which is supported on metallic frame angle members 11 and 12. Angles 11 and 12 are suitably reinforced and extend rearwardly and support additional tanks to tank 10, which are spaced from the tank 10 and disposed generally parallel to tank 10 and constitute the other phases of the circuit breaker. The metallic tank 10 is a grounded housing and the circuit breaker shown herein for purposes of illustrating the invention is shown in a "dead tank" configuration.

The terminal bushings for the breaker may be of any standard type and are shown for illustration herein as including the bushings 13 and 14 which extend through cylindrical shrouds 15 and 16, respectively, which are appropriately welded or otherwise secured to the tank 10 and are sealed relative to the interior of the tank. The structural bushing supports and gas barriers 17 and 18, repsectively, are provided to prevent the leakage of gas from the bushings 13 and 14 and the tank 10. Thus, tank 10 is filled with sulfur hexafluoride gas (or a gas mixture which includes sulfur hexafluoride) at a pressure of about 3 atmospheres. For purposes of the invention, any dielectric gas at any appropriate pressure could be used. For the embodiment described herein, the gas pressure within tank 10 will be designated a relatively low pressure.

Each of the bushings 13 and 14 is further associated with current transformers 19 and 20, respectively, which may also be of any desired construction.

A grounded flat support platform 21 is contained within the tank 10 and is supported from the bottom of tank 10 by welded support members, such as bolts 22 and 23 and others not shown. Platform 21 sits on leveling nuts, such as nuts 24 and 25, respectively, of the support bolts. The platform 21 then serves as level mount for the circuit interrupter equipment to be contained within tank 10. In the case of the breaker shown in FIG. 1, four interrupters are connected in series with one another to divide the circuit breaker operating voltage of 230 KV. Platform 21 supports two spaced hollow tubular insulation support members 26 and 27, respectively, which further serve the purpose of high pressure gas reservoirs as is more fully described in copending application Ser. No. 398,868, filed Sept. 19, 1973, now U.S. Pat. No. 3,889,083, in the name of G. P. Guaglione et al, entitled, GAS CIRCUIT BREAKER INSULATING TUBE SUPPORT AND HIGH PRESSURE VESSEL and assigned to the assignee of the present invention.

Each of the insulation support members 26 and 27 support, at their tops, respective blast valve housings 28 and 29 which, in turn, support series-connected interrupter units 30–31 and 32–33, respectively. Each of the interrupter units contains a pair of interrupter contacts which are simultaneously opened in the presence of a blast of gas which assists in extinguishing the arc. It is to be noted that the tubes 26 and 27, blast valve housings 28 and 29, and interrupters 30 to 33 are mechanically supported solely from the platform 21 and that none of these components are supported from the bushings 13 and 14 or intermediate supports for the interrupters 31 and 32.

The top of interrupter 30 is electrically connected to the stud 35 of terminal bushing 13 through a flexible connection, which will be later described. The connection between the top of interrupter 30 and stud 35 is then covered by a corona shield 36.

The bottom of interrupter 30 is then connected through housing 28 to the bottom of interrupter 31. The top of interrupter 31 is connected through flexible shunts 36a to the top of interrupter 32 with the tops of interrupters 31 and 32 and flexible conectors covered by corona shields 37 and 38, respectively.

The bottom of interrupter 32 is then connected through the blast valve housing 29 to the bottom of interrupter 33. The top of interrupter 33 is in turn connected to the stud 39 of bushing 14 by flexible connectors, such as flexible connectors 40 and 41. The connection previously referred to between interrupter 30 and stud 35 incorporates flexible connectors, such as the connectors 40 and 41. The connection to stud 39 is then covered by the corona shield 42.

FIG. 1 also shows voltage distributing impedances 43 and 44 connected across interrupters 30 and 33, respectively. Note that any suitable arrangement of parallel-connected capacitors or resistors **43*a* could be used across the various interrupters 30 to 33** in order to assure appropriate distribution of steady state and transient voltages across the series-connected breaks, generated during closing or to assist in arc interruption during the opening of the breaker.

FIG. 1 illustrates the provision of transient recovery voltage capacitors 50 and 51 which are to be connected from either of the line sides of the breaker to ground. It will be noted that the flattened elliptical shape of tank 10 makes available free space in the outer central regions of the tank so that these capacitors can be mounted within this space without interference with the operation of the breaker or without interference with the dielectric integrity of the breaker. The mounting of these capacitors is the subject of the copending application Ser. No. 398,869, filed Sept. 19, 1973, now U.S. Pat. No. 3,903,388 in the name of Lorne D. McConnell, entitled MECHANICAL SUPPORT OF TRANSIENT RECOVERY VOLTAGE CAPACITOR WITHIN CIRCUIT BREAKER LOW PRESSURE TANK, and assigned to the assignee of the present invention.

It will be noted from FIG. 1 that the upper terminals of each of capacitors 50 and 51 are connected by relatively rigid conductors 52 and 53 to the tops of interrupters 30 and 33, respectively, and are directly and solidly connected to the bushing studs 35 and 39, respectively. The bottoms of capacitors 50 and 51 are then mechanically and electrically connected to the tank wall 10 by the support and grounding brackets 54 and 55, respectively.

The transient recovery voltage across the breaker is then controlled by the capacitors 50 and 51 in the manner generally set forth in U.S. Pat. No. 3,383,519, it being noted that each of capacitors 50 and 51 may have a value of approximately 0.0025 microfarads or any other desired value selected by the circuit designer. The transient recovery voltage may also be controlled by resistor 43*a* inserted during the opening stroke of the breaker.

The interior of the insulation reservoirs 26 and 27, which communicate with the blast valve housings 28 and 29 and thence to the interrupters 30 and 33 is at a relatively high pressure, such as 15 atmospheres of the same dielectric gas which fills tank 10.

The major pressure source for the breaker is an elongated cylinder 60 which is filled with gas at high pressure (for example, 265 p.s.i.g. at 70°F.), which temperature is maintained by a heater blanket 61 which covers cylinder 60 to ensure that the gas temperature will always be sufficiently high to prevent liquefaction. Liquefaction occurs in the high-pressure system at about 54°F. A protective shroud 62 covers the cylinder 60 (which may extend the full length of all of the phases of the breaker), with portholes such as porthole 63 being available to permit maintenance of the cylinder 60 and the blanket 61. A suitable gas control system, which need not be described to understand the present invention, provides suitable gas conduits and gas controls to conduct gas from the cylinder 60 through the conduit 64 which passes through a sealing plug 65 in tube 66 which is secured to tank 10.

The high-pressure conduit 64 then extends through a T-shaped member and into conduits 67 and 68 as generally out-lined by the arrows, in FIG. 1, such that high-pressure gas is admitted to the interior of insulation reservoirs 26 and 27. As will be later described, this gas is normally sealed at the blast valve housings 28 and 29 and high-pressure gas is released through the interrupters 30 to 33 into low-pressure tank 10 only when the contacts of the interrupters are operated.

A suitable mechanical operating mechanism (not shown herein) is provided to mechanically actuate crank arms, such as crank arm 70 associated with tube 26, which drive operating rods which extend through the center of support tubes 26 and 27 and upwardly to blast valve housings 28 and 29. Similar crank arms will be associated with each of the other interrupters of each phase of the breaker. Any conventional operating mechanism, such as a pneumatic or spring operated mechanism or hydraulically operated mechanism is then connected to each of the crank arms so that all blast valves and contacts can be simultaneously operated to either open or close all interrupter contacts. Optionally each pole of the breaker may be equipped with its own mechanism to affect individual pole operation.

Figure 2:
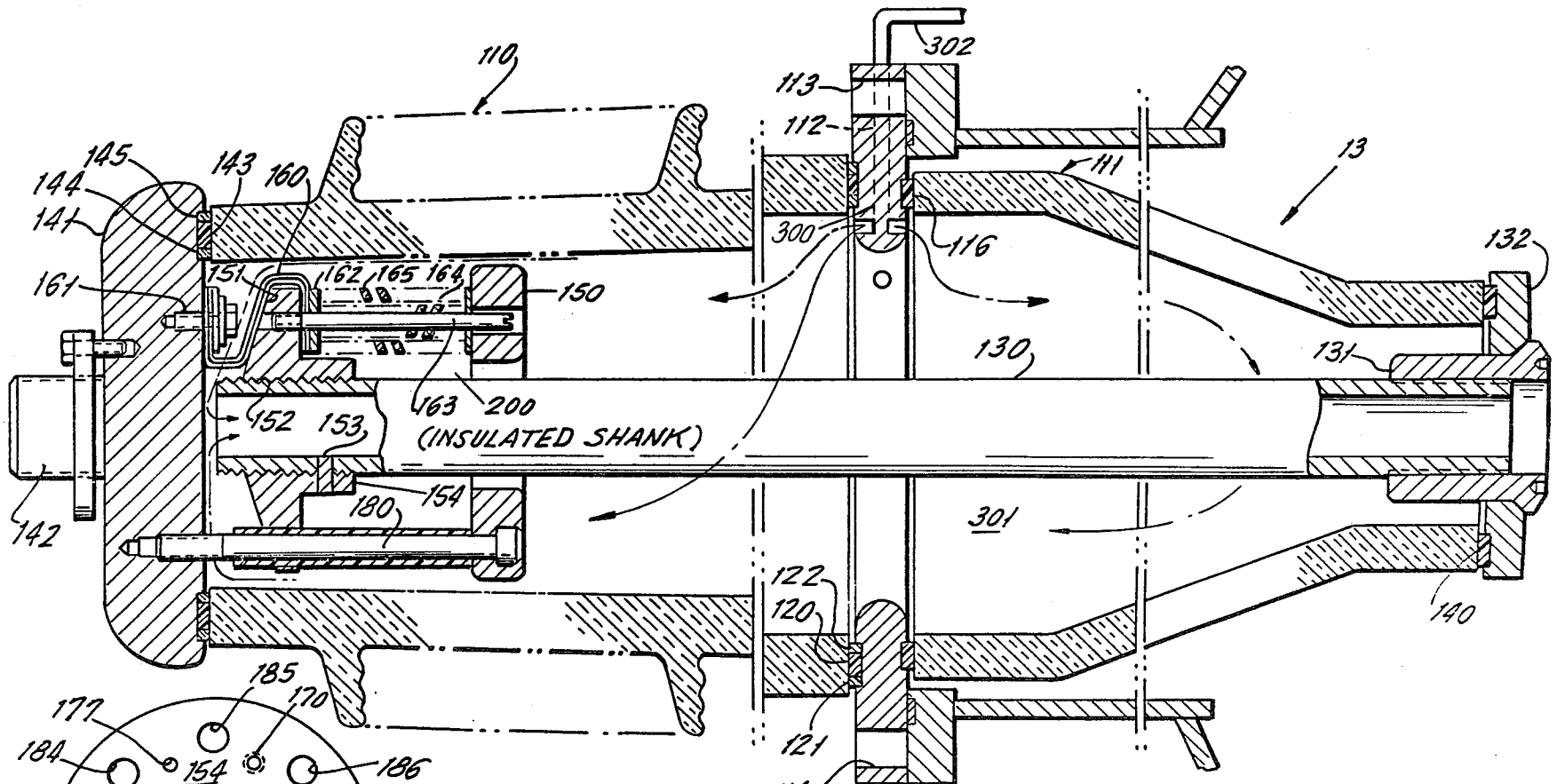
FIG. 2 is a cross-sectional view of the bushing which is used for the circuit breaker of FIG. 1 and which is modified in accordance with the present invention.
Figure 3:
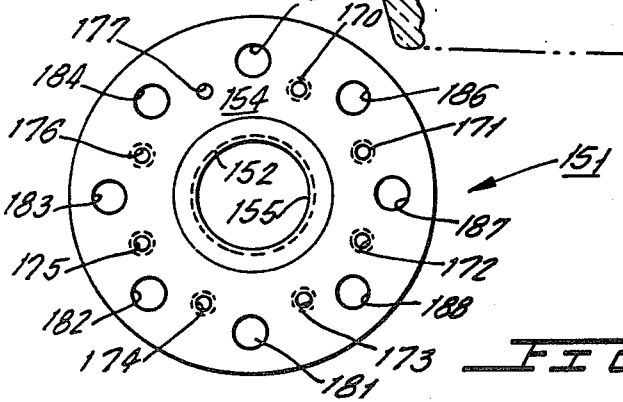
FIG. 3 is a plan view of the flange of the bushing of FIG. 2.

FIGS. 2 and 3 show the interior construction of the bushings 13 and 14 in detail, for the case of bushing 13. The construction of the bushing of FIGS. 2 and 3 is derived from U.S. Pat. No 3,566,001.

Referring to FIG. 2, there is illustrated an insulation bushing which consists of two insulator columns 110 and 111 which may be of any standard configuration and which are joined in end-to-end relation through an annular mounting flange 112. The annular mounting flange 112 is of the standard type and contains numerous bolt hole openings, such as bolt holes 113 and 114, such that the insulator can be mounted to any suitable enclosure such as the fragmentarily shown enclosures 15 and 16 of FIG. 1. Thus, the entire section 111 will be immersed within enclosures 15 and 16 of FIG. 1.

Relatively hard, load-supporting gaskets 116 and 140 may, therefore, be provided between the flange plates 112 and 132 and insulator section 111 to protect the insulator from damage by coming into contact with these metal plates, since leakage at this joint is allowable since both the interior of the tank 10 and the interior of the insulation column are filled with gas at the same pressure.

The insulation section 110, however, is positioned above the exterior of the tank 10 so that an extremely effective seal must be provided between the flange plate 112 and insulator 110. This seal is shown in FIG. 2 as consisting of a relatively hard, load-supporting compression gasket 120 contained within suitably soft, sealing stop gaskets 121 and 122. The insulator bushing 13 of FIGS. 1 and 2 then contains a main elongated conductor 130 which is threaded into a conductive adapter 131 which is received by the conductive head plate 132. Electrical equipment within the housing 10 which are to be connected to conductor 130 are connected thereto through a suitable threaded connection, for example, with the adapter 131.

Note that the conductive tube 130 is hollow and will communicate with the interior of tank 10.

The outer end of the insulation bushing 13, as shown to the left in FIG. 2, contains a well-contoured end conductive plate 141 which may have a threaded terminal 142 extending therefrom so that convenient connection may be made to the bushing. Conductive member 141 is then sealed to the left-hand end of hollow insulator section 110 by a good pressure seal consiting of the hard, load-bearing compression gasket 143 and its relatively soft, sealing stop gaskets 144 and 145. It will be noted that the left-hand end of conductor 130 is spaced from conductive member 141 so that the conductor 130 may expand and contract at a different rate than insulator sections 110 and 111, due to temperature change.

Electrical connection between conductive member 141 and the central conductor 130 and the means for holding the insulator assembled are provided by a spring-receiving disc 150 and a conductive flange member 151 which is threaded onto the left-hand end and top of conductor 130. Flange member 151 is shown in plan view in FIG. 3. It will be noted that flange member 151 has a threaded interior 152 which is threaded onto the end of conductive tube 130 and then fixed in this position by pin 153 which extends through a suitable opening in the upstanding wall 154, shown as opening 155 in FIG. 3 to prevent subsequent rotation of one flange member 151 with respect to conductor 130 after the bushing has been assembled.

Electrical connection is made between conductive member 140 and flange plate 151 and thus conductor 130 by means of flexible, conductive straps. These flexible, conductive straps may be packages of thin, copper sheets. A typical flexible conductor of this type is shown in FIG. 2 as flexible conductive member 160.

A plurality of such flexible members will be distributed around the periphery of flange member 151.

One end of the conductive members, such as conductive member 160 is bolted to the interior of conductive member 141 as by the bolt 161, while the other end envelopes around the exterior of the flange as shown, and is disposed beneath a pressure washer 162. Note that conductive member 160 may have an opening therethrough for passing a threaded insulated shank 163 which serves as a spring guide for the parallel springs 164 and 165. One end of springs 164 and 165 bears on pressure washer 162 in order to make good electrical contact between conductor 160 and flange 151. The other ends of springs 164 and 165 rest on insulated washers 200 which are carried on disc 150 as shown. Note that parts 163, 180 and 200 are insulated to prevent the various springs and bolts from carrying current and sparking to parts 150 and 151.

As mentioned above, a plurality of such assemblies are disposed about the flange member 151 where FIG. 3 illustrates an opening 170 for threadably receiving threaded shank 163, with the entire assembly of springs 164, 165, shank 163 and conductor 161 being associated with this portion of the cosssectional view.

Seven similar assemblies will be similarly associated with threaded openings 171 to 177, shown in FIG. 3 for receiving the threaded shanks of the respective assemblies.

Spring-receiving disc 150 is then rigidly threaded into engagement with conductive member 141 as by insulated bolts such as bolt 180, shown in FIG. 1. Note that bolt 180, along with seven other bolts in the preferred embodiment of the invention, will also pass through aligned openings in flange member 151, these openings being shown in FIG. 2 as through-openings 181 to 188.

It will be observed that the springs, such as springs 164 and 165, will serve to hold the entire insulator bushing in mechanical alignment, with the insulator sections 110 and 111 being in compression. That is, springs 164 and 165 are compression springs which urge members 150 and 151 away from one another. This has the effect of pressing conductive end members 141 and 132 toward one another, thereby applying forces tending to hold the bushing assembled and applying pressure to the various seals throughout the assembly. At the same time, a strong pressure connection is made between flexible conductive strap 160 and the flange 151 to establish a good path for electrical current from conductive member 141 through the flexible conductors to conductive flange 151 and thence through conductor 130 to the adapter 131.

It will be observed that if there should be dimensional changes of conductor 130 with respect to the insulator housings 110 and 111, these dimensional changes will be easily absorbed by the flexible conductors, such as conductor 160, without danger of cracking, while a good pressure seal is maintained throughout the interior of the insulator for those portions of the insulator bushing which are above the housing 10.

THE IMPROVEMENT OF THE PRESENT INVENTION

In accordance with the present invention, an opening 300 is formed in the annular mounting flange 112 of each bushing 13 and 14 where the opening 300 communicates between the internal volume 301 of the bushing and the exterior of the opening 300. The opening 300 is then connected to a hollow conduit 302 and the conduit 302 is in turn coupled to a permanently open restriction orifice 303. Note that conduit 302 may be inside or outside tank 10, as shown for bushings 13 and 14, respectively Orifice 303 may pass about 0.4 cubic feet per minute of $SF_6$ gas and will have a pressure drop thereacross of about 220 p.s.i.g. A gas filter 304, which can be a molecular sieve type filter which will remove moisture from the gas passed therethrough, is connected between orifice 303 and high-pressure gas source cylinder 60. Note that, in an installation of a three-phase circuit breaker, a similar construction will be provided for each of the six bushings of the circuit breaker.

The novel invention permits a continuous flow of heated gas at about 70°F. from the high-pressure container 60 into the interior of the low-pressure tank 10, taking the path shown by the arrows in FIGS. 1 and 2. Thus, as shown in FIGS. 1 and 2, a constantly metered flow of gas through the constantly open orifice 303 flows through the opening 300 and then into the space 301 which, in the prior art, was a dead space. The gas then flows upwardly through the annular volume 301 to the top of hollow conduit 130 and then down through the center of hollow conduit 130, and into the interior of low-pressure housing 10. The gas will continue to flow into the interrupters 32 and 33, for example, and will be discharged through the various openings in the corona shields, such as openings 89 and 90 in FIG. 1 onto the free volume within tank 10. A bypass conduit 320, containing manual valves 321, 322 and 323 permits servicing the filter 304 and orifice 303 with the breaker in service.

There is in general a continuing flow of gas through the circuit breaker system, causing the frequent or constant operation of the compressor connected between the low-pressure interior of housing 10 and the high-pressure tank 60, thereby to ensure compressor operation and to ensure the constant removal of moisture from the gas in the filter, such as filters 304. The compressor, which may be of the type shown in U.S. Pat. No. 3,602,669, assigned to the assignee of the present invention, is connected to the interior of housing 10 and to the interior of tank 60 in any desired manner, as illustrated by the dotted lines in FIG. 1. The gas in the low presure regions of the bushing and tank is at a pressure of about 45 p.s.i.g., and the flow of 0.4 C F M of gas from cylinder 60 provides about 1.6 BTU's per minute of heat energy in the low-pressure system. This is then sufficient to maintain the low-pressure system gas at a temperature below −40°F. for ambient conditions of −50°F., thereby to prevent partial liquefaction of the low-pressure gas.

FIG. 1 shows the bypass assembly for bushing 14 outside the tank 10 for easy access for servicing. If desired, however, the complete piping system 302, 303, 304 may be located within the low-pressure tank 10 as shown for bushing 13. In the event of leakage of any component, a gas loss to atmosphere would not occur. Instead the gas would be contained within the low-pressure tank 10. The internal plumbing and parts of the bypass system can then be serviced during the normal maintenance outage.

Although this invention has been described with respect to preferred embodiments, it should be understood that many variations and modifications will now be obvious to those skilled in the art, and it is preferred, therefore, that the scope of the invention be limited, not by the specific disclosure herein, but only by the appended claims.

The embodiments of the invention in which an exclusive privilege or property is claimed are defined as follows:

1. A two-pressure circuit breaker comprising, in combination:

a grounded hollow tank structure which is filled with a gas at relatively low pressure;

a source of relatively high-pressure gas;

means heating said source of relatively high pressure gas;

at least one circuit interrupter mounted within said tank structure and having gas blast valve means therein connected to said source of high-pressure gas and operable to connect said high pressure gas source to the interior of said hollow tank structure during circuit interruption;

first and second terminals for said interrupter which each extend through the wall of said tank structure for enabling the connection of external circuits to said circuit interrupter; at least said first terminal comprising a terminal bushing having an external elongated hollow insulation housing supported by said tank structure and having a hollow elongated conductor extending through said insulation housing and being spaced from the interior walls of said insulation housing to define an elongated annular chamber;

means for isolating said annular chamber from said low-pressure tank structure;

said hollow conductor having one end disposed within said tank structure and communicating with the interior of said tank structure and isolated from said annular chamber and having a second end communicating with said annular chamber;

and means for injecting heated gas from said source of relatively high-pressure gas at relatively low pressure into said annular chamber; said gas injected being free to flow through said annular chamber, into said hollow conductor second end, through said hollow conductor, and into said low-pressure tank structure;

compressor means connected between said source of high-pressure gas and said hollow tank;

and permanently open restriction means connected between said high-pressure source and said means for injecting gas, restricting the flow of gas into said annular chamber to a given and relatively small volumetric flow.

2. The two pressure circuit breaker of claim 1 wherein said source of relatively high-pressure gas is at a pressure of about 265 p.s.i.g. at 70°F., and wherein said lowpressure tank is at a pressure of about 45 p.s.i.g., and wherein said heated gas flowing into said annular chamber flows at a rate to maintain the temperature of said gas in said low-pressure region at a temperature above about −40°F. at ambient temperatures of about −50°F.

3. The device of claim 2 which further includes gas filter means connected in said means for injecting gas into said annular chamber.

4. The device of claim 3 wherein said restriction means and said gas filter means are each disposed externally of said hollow tank structure.

5. The device of claim 3 wherein said restriction means and said gas filter means are each disposed internally of said hollow tank structure.

6. The two-pressure circuit breaker of claim 1 wherein heated gas flows into said annular chamber at a rate of about 0.4 cubic feet per minute, and maintains the temperature of said gas in said tank structure at a temperature below the liquefaction temperature of said low-pressure gas.

* * * * *